US007823314B1

(12) United States Patent
Wheatley

(10) Patent No.: US 7,823,314 B1
(45) Date of Patent: Nov. 2, 2010

(54) FIREARM WITH A DETACHABLE BARREL AND SUPPRESSED BARREL ASSEMBLY

(76) Inventor: Craig A. Wheatley, 345 Sunrise Rd., Bonners Ferry, ID (US) 83805

( * ) Notice: Subject to any disclaimer, the term of this patent is extended or adjusted under 35 U.S.C. 154(b) by 0 days.

(21) Appl. No.: 12/315,251

(22) Filed: Dec. 2, 2008

(51) Int. Cl.
*F41A 21/48* (2006.01)

(52) U.S. Cl. ..... 42/75.02; 89/14.4

(58) Field of Classification Search ..... 42/75.02, 42/75.04; 89/14.4
See application file for complete search history.

(56) References Cited

U.S. PATENT DOCUMENTS 1,696,537 A * 12/1928 Kewish ..... 89/132
2,455,608 A * 12/1948 Rosengren ..... 42/75.01
2,817,174 A 12/1957 Liedke
2,958,974 A 11/1960 Sefried, II
3,034,407 A * 5/1962 Darsie ..... 89/14.05
3,150,458 A 9/1964 Browning
4,109,403 A 8/1978 Badali
4,939,977 A * 7/1990 Stroup ..... 89/14.4
6,427,372 B1 * 8/2002 Howard et al. ..... 42/71.01
2005/0188590 A1 * 9/2005 Baber et al. ..... 42/75.02

* cited by examiner

*Primary Examiner*—Stephen M Johnson
(74) *Attorney, Agent, or Firm*—Wood, Herron & Evans LLP

(57) ABSTRACT

A semi-automatic pistol with a detachable barrel and/or a detachable suppressed barrel assembly consists of a new or replacement interchangeable barrel receiver of a type similar to that of the Ruger™ Mk I/II/III or .22/45™ pistols with user interchangeable barrels. The interchangeable barrel receiver incorporates a feed ramp and has alignment surfaces that provide positive alignment with the user interchangeable barrel or sound suppressed barrel assembly. Means are provided for allowing the user to change barrels.

5 Claims, 11 Drawing Sheets

FIREARM WITH A DETACHABLE BARREL AND SUPPRESSED BARREL ASSEMBLY

BACKGROUND OF THE INVENTION

1. Field of the Invention

This application relates broadly to a firearm, specifically a semi-automatic pistol, and more particularly, it concerns an interchangeable barrel receiver semi-automatic pistol with a (1) detachable barrel and/or (2) a detachable suppressed barrel assembly.

2. Description of the Prior Art

Detachable barrels for semi-automatic pistols, specifically .22 caliber pistols, are well known in the art. Examples of prior art for .22 caliber semi-automatic pistols include the following U.S. Pat. Nos. 2,817,174 (Liedke), 2,958,974 (Sefried II), 3,150,458 (Browning), and 4,109,403 (Badali). One of the most popular .22 caliber semi-automatic pistols is made by Ruger™ and has been made since 1949 in a number of models. These are known as the Ruger™ Mk I/II/III™ and .22/45™ pistols. These pistols are available in different barrel lengths, but due to the design and construction of these pistols, the barrel is not easily removable and is not intended to be removed by the user. The main problem is that the barrel attaches to the receiver of the pistol by screw threads, the assembly which is then machined as and into a single combined part, which is the part of the pistol that has the serial number on it. As such, legally the receiver is considered to be the firearm. Subsequently, if a shooter desires to use an alternate length barrel than the one that is fitted to their .22 Ruger™ semi-automatic pistol, he is forced to purchase another pistol with the desired length barrel since Ruger™ as the manufacturer does not intend for the barrel and receiver to be separated. The existing Ruger™ pistols do not lend themselves easily to allow for a detachable barrel that is able to be easily changed by the user.

The Ruger™ .22 caliber semi-automatic pistols are also very popular when fitted with a sound suppressor, and very commonly the sound suppressor is constructed to incorporate a ported barrel with the Ruger™ pistols. Use of a ported barrel with such sound suppressed pistols prevents the shooter easily changing the barrel and suppressor for a different length suppressor assembly that provides better sound reduction. What is needed is a new or replaceable receiver for a Ruger™ .22 caliber semi-automatic pistol or a pistol of similar type that provides for a detachable barrel to be used with the receiver, and provides the user with the capability to quickly change barrels with different lengths and model features. The pistol or receiver should also allow for use of a quick detachable sound suppressed barrel assembly for those shooters who are legally able to possess and use such Federally registered firearms. The pistol or receiver and quick detachable barrels or quick detachable sound suppressed barrel assemblies should ensure that there are positive alignment surfaces on the barrels and suppressed barrel assemblies and corresponding alignment surfaces on the pistol or receiver. This is to ensure that positive alignment occurs when the quick detachable barrel or suppressed barrel assembly fits into the pistol or receiver. This is achieved through the provision of a pistol or a new or replacement receiver that incorporates a quick detach mechanism that allows for the use of quick detachable barrels and sound suppressed barrel assemblies.

OBJECTS

A principal object of the invention is to provide a pistol or a new or replacement receiver of a type similar to that of the Ruger™ Mk I/II/III™ and .22/45™ .22 caliber semi-automatic pistols that allows for the use of user interchangeable barrels.

A further object of the invention is to provide a pistol or a new or replacement receiver of a type similar to that of the Ruger™ Mk I/II/III™ and .22/45™ .22 caliber semi-automatic pistols that allows for the use of user interchangeable sound suppressed barrel assemblies.

A further object of the invention is to provide a pistol or a new or replacement receiver of a type similar to that of the Ruger™ Mk I/II/III™ and .22/45™ .22 caliber semi-automatic pistols that features a user interchangeable barrel or sound suppressed barrel assembly that incorporates alignment surfaces to provide a positive alignment between the interchangeable barrel or sound suppressed barrel assembly and the receiver.

Other objects and further scope of applicability of the present invention will become apparent from the detailed descriptions given herein; it should be understood however, that the detailed descriptions, while an indication of preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of a pistol or a new or a replacement receiver of a type similar to that of the Ruger™ Mk I/II/III™ or .22/45™ pistols comprising:

(a) a receiver with user interchangeable barrels for a Ruger Mk I/II/III or .22/45 either as a replacement or new manufacture;

(b) a receiver that utilizes user interchangeable barrels wherein the receiver incorporates a feed ramp in and of itself independent of the presence or absence of an installed barrel;

(c) an interchangeable barrel receiver that consists of a multiple part assembly relating to the functionality of the barrel interchangeability;

(d) a barrel or sound suppressed barrel assembly that has alignment surfaces that provide positive alignment with the receiver; and (d) a means for allowing the user to change barrels.

A first unique improvement provided by the invention is an interchangeable barrel receiver that incorporates a feed ramp independent of the presence or absence of an installed barrel. The barrel for the Ruger™ pistols has a feed ramp as part of the barrel rather than as part of the receiver just as other quick detach .22 caliber pistols include a feed ramp as part of the barrel. Incorporating the feed ramp as a part of the receiver results in reduced machining and manufacturing costs when manufacturing multiple interchangeable barrels.

A second unique improvement provided by the invention is to provide a barrel or sound suppressed barrel assembly that has alignment surfaces as part of the barrel or sound suppressed barrel assembly that align with alignment surfaces in the receiver. These ensure that a positive alignment occurs when the barrel or sound suppressed barrel assembly is fitted into the extended receiver.

A third unique improvement is the provision of a quick detach barrel mechanism as part of the receiver. This quick detach mechanism comprises a spring-biased lever or catch that is forced up under pressure from the spring acting upon a shoulder on the bottom of the lever or catch. The lever or catch fits into a cut-out in the barrel or sound suppressed barrel assembly positioned on the bottom of the barrel or sound suppressed barrel assembly. Activation of the quick detach mechanism is achieved by simply pushing the lever or catch upwards against the spring pressure. This allows for the removal of the barrel or sound suppressed barrel assembly from the receiver and insertion of the barrel or sound suppressed barrel assembly into the interchangeable barrel receiver.

BRIEF DESCRIPTION OF THE DRAWINGS

Referring particularly to the drawings for the purposes of illustration only, and not limitation.

DESCRIPTION OF PREFERRED EMBODIMENT

Figure 1:
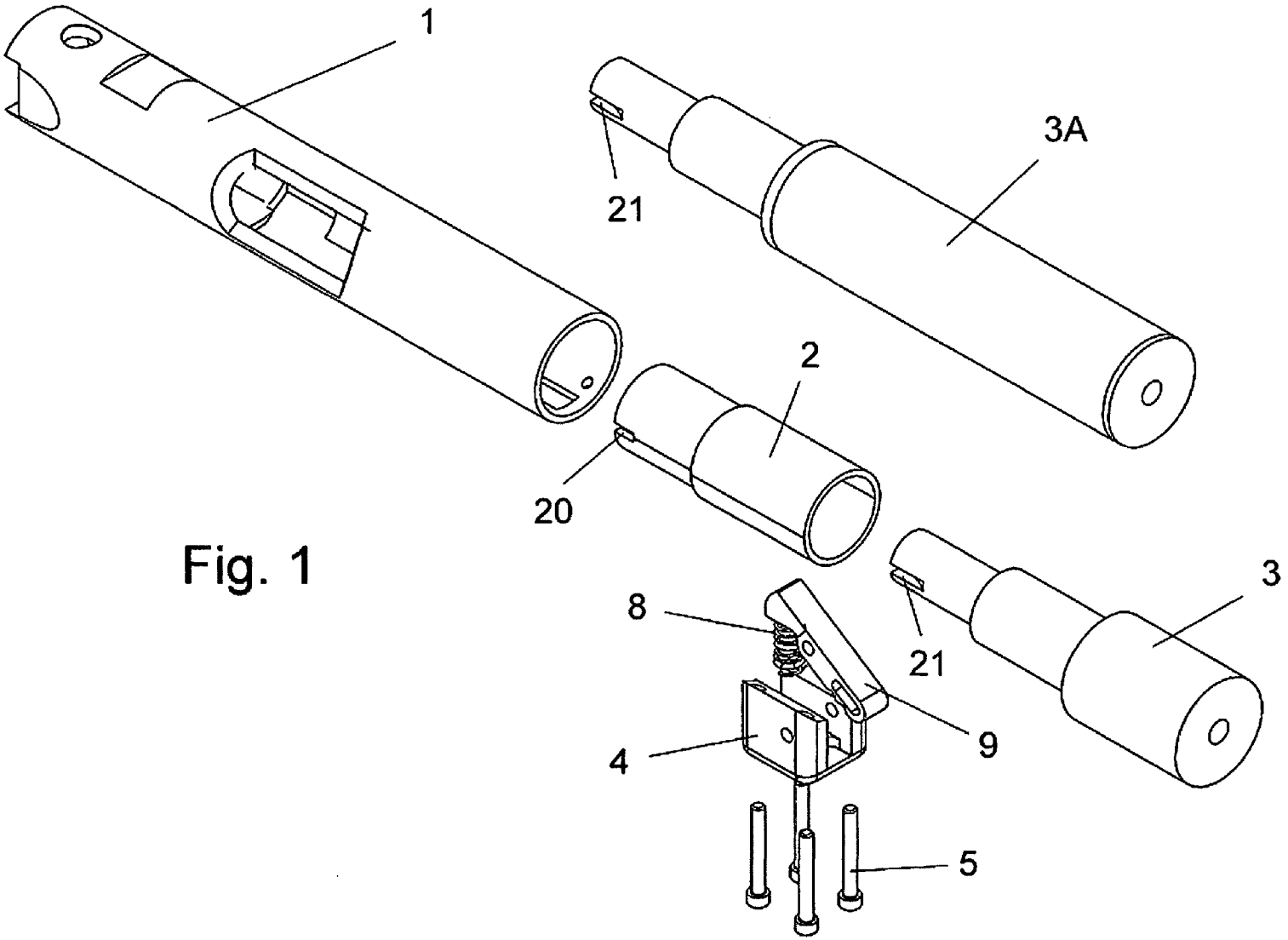
FIG. 1 is an exploded perspective view of an interchangeable barrel receiver and the quick detach mechanism.
Figure 2:
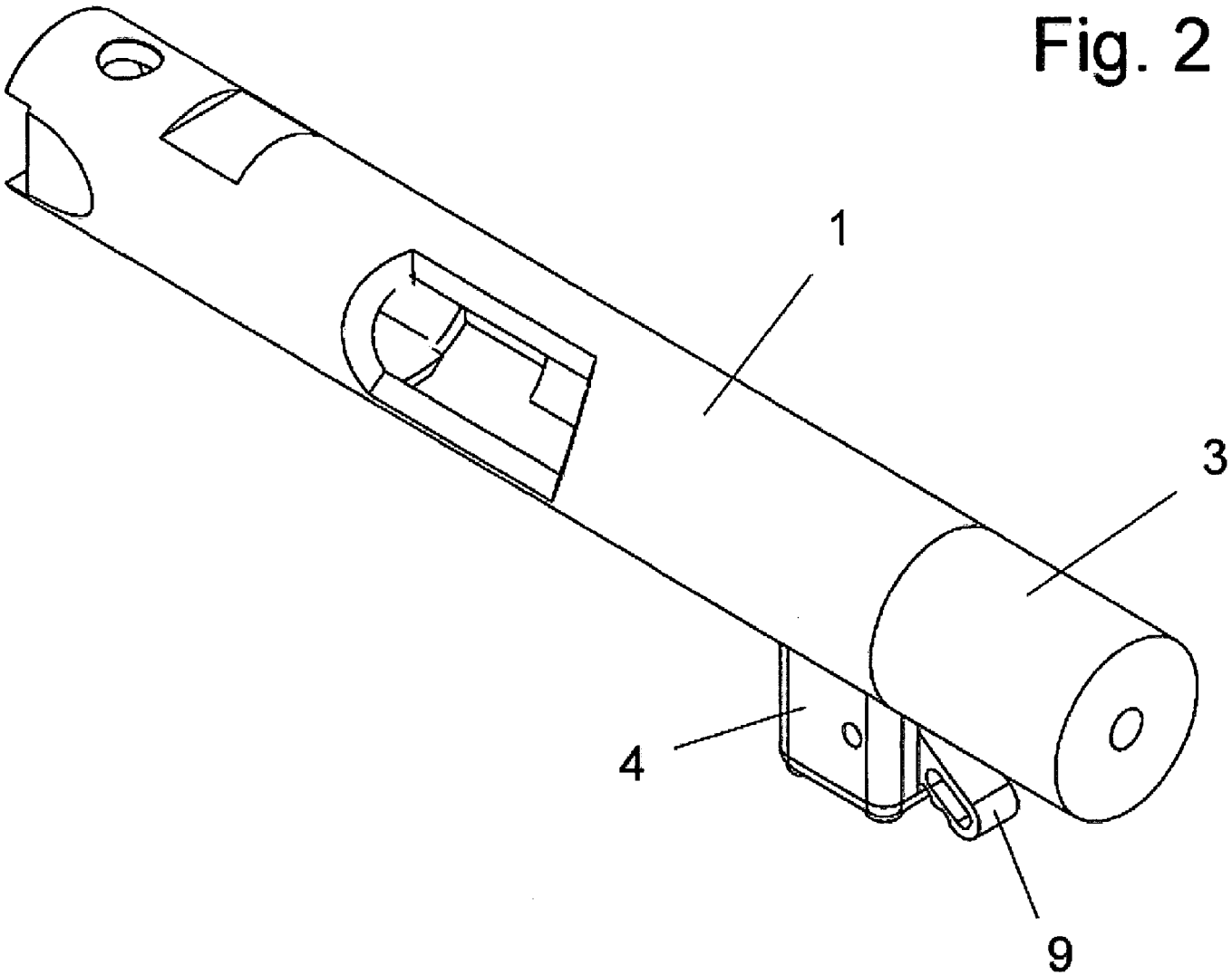
FIG. 2 is an assembled perspective view of an interchangeable barrel receiver with the quick detach mechanism.
Figure 3:
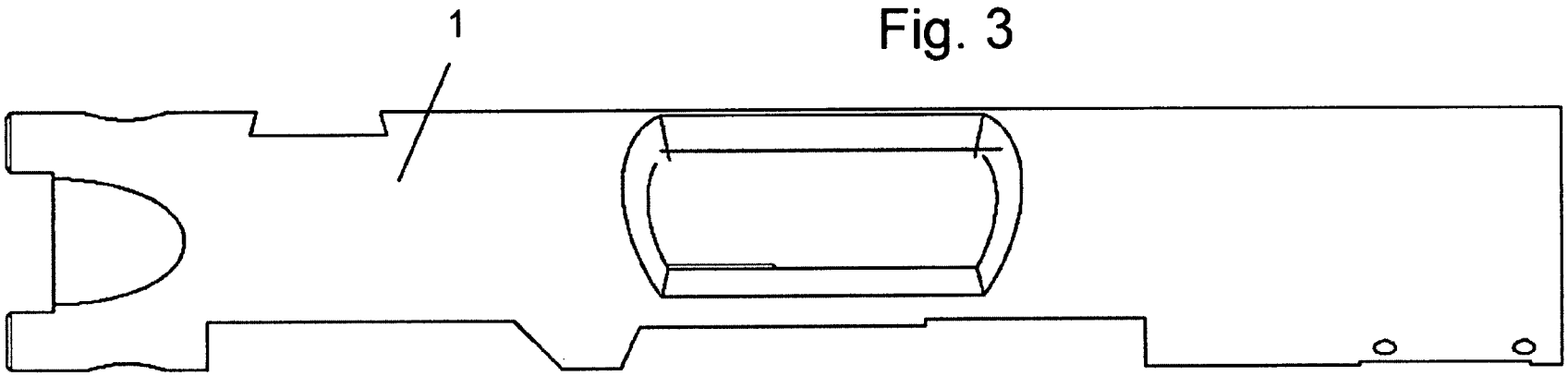
FIG. 3 is a side perspective view of an interchangeable barrel receiver without the quick detach mechanism.
Figure 4:
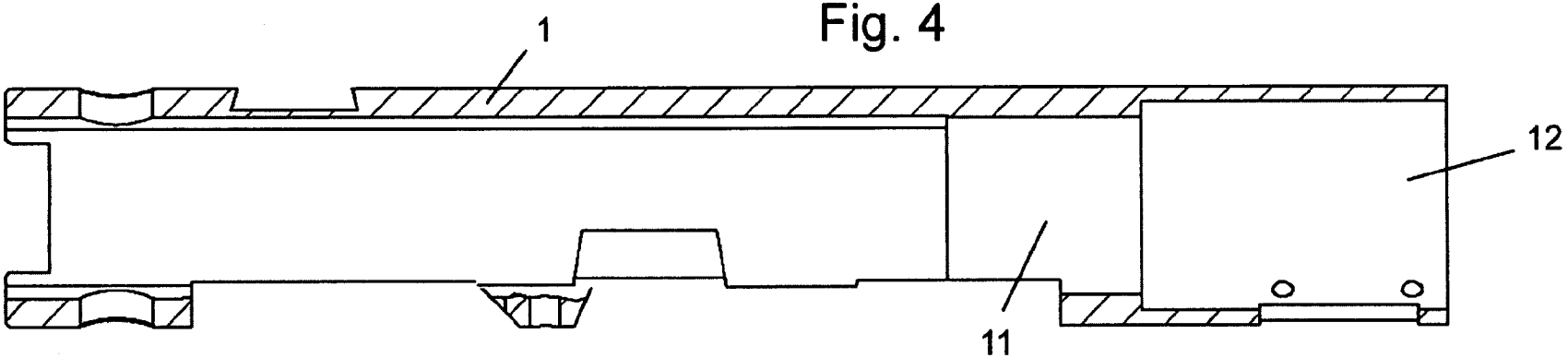
FIG. 4 is a cross-sectional view of an interchangeable barrel receiver.
Figure 5:
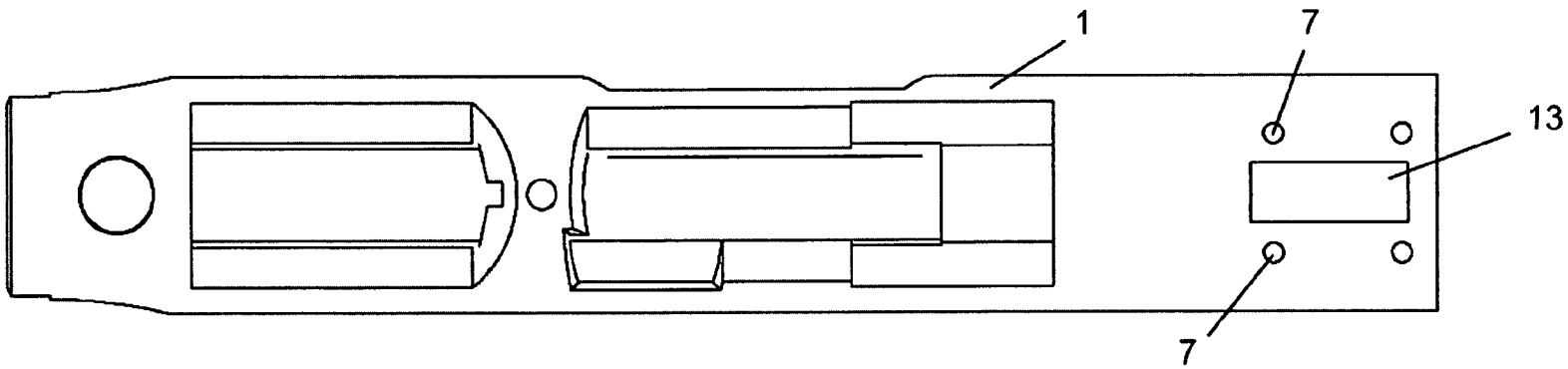
FIG. 5 is a bottom view of an interchangeable barrel receiver without the quick detach mechanism.
Figure 6:
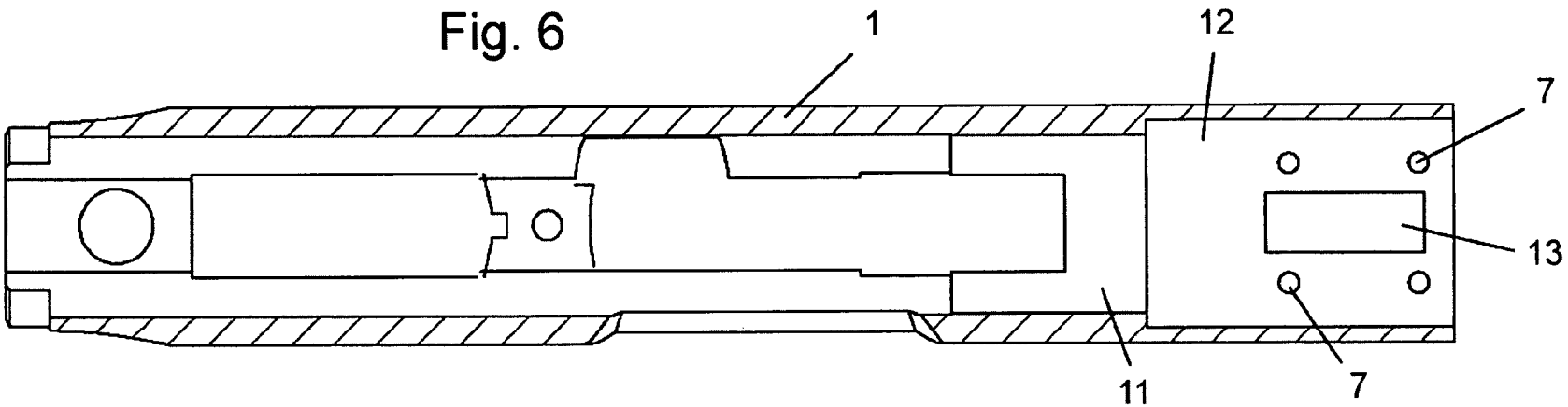
FIG. 6 is a cross-sectional bottom view of an interchangeable barrel receiver.
Figure 7:
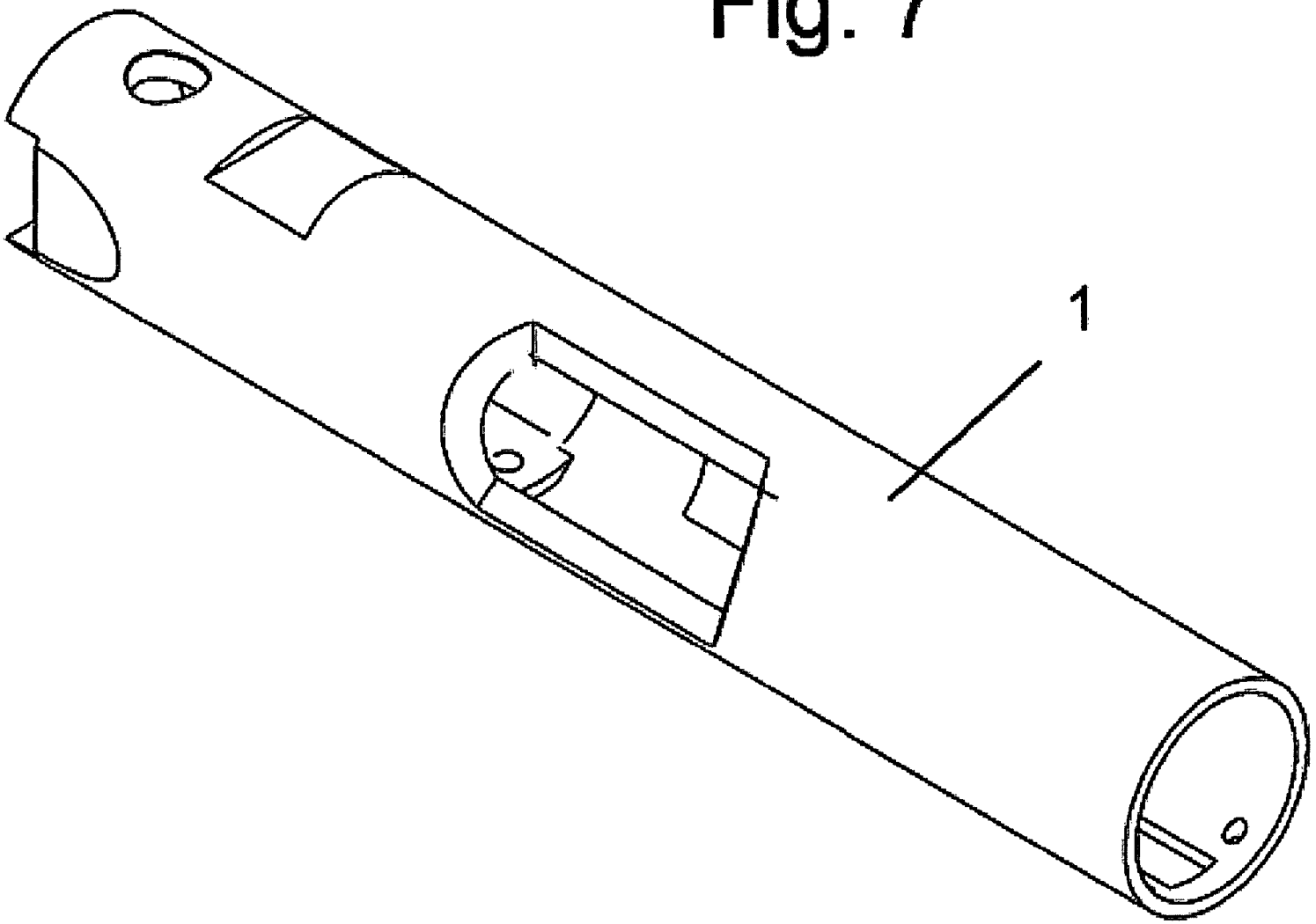
FIG. 7 is a perspective view of an interchangeable barrel receiver without the quick detach mechanism.
Figure 8:
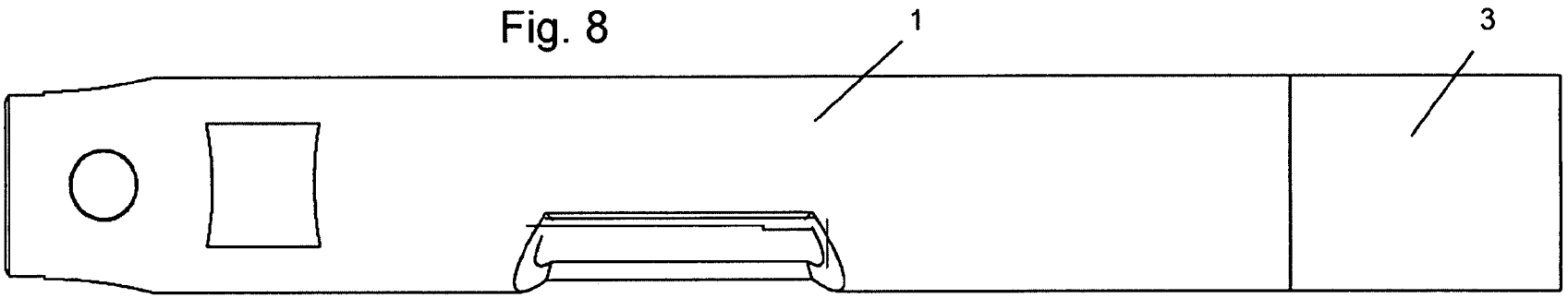
FIG. 8 is a top view of an interchangeable barrel receiver with the quick detach mechanism.

FIGS. 1 and 2 show an interchangeable barrel receiver that incorporates a quick detach mechanism, a bushing that incorporates a feed ramp, and a quick detach barrel in exploded and assembled perspective views. The interchangeable barrel receiver 1 is of a type similar to that of the Ruger™ Mk I/II/III™ or .22/45™ pistols and may replace the existing receiver of a Ruger™ Mk I/II/III™ or .22/45™ pistol if so desired, or may form the basis for the receiver of a pistol of similar design and appearance to that of the Ruger™ Mk I/II/III™ or .22/45™ pistols. The interchangeable barrel receiver 1 in this instance is extended in length when compared to the receiver of the Ruger™ Mk I/II/III™ or .22/45™ pistols to allow for the use of a quick detach mechanism for replacing or changing barrels or it may be of identical length as dictated by mating parts compatibility. A bushing 2 is secured to the interchangeable barrel receiver. The bushing 2 is machined internally to allow for insertion and removal of a barrel 3 or sound suppressed barrel assembly 3*a*. Sound suppressed barrel assembly 3*a* is a barrel that has a sound suppressor that is part of the barrel and as such is well known in the art. Barrel 3 may also be provided with a thread or other attachment method to allow for attachment of a detachable sound suppressor if so desired. The quick detach mechanism consists of a housing 4 that is secured to the interchangeable barrel receiver 1 by a plurality of screws 5 though other methods of retention may be used. Housing 4 is shown with a plurality of holes 6 for screws 5 to fit into. In the preferred embodiment, a series of holes 7 are positioned on the underside of the extended length receiver as shown in FIGS. 3, 4, 5, and 6 and screws 5 thread into these holes 7 and could also be attached using other methods such as welding or dovetail joints. A spring 8 and a catch 9 are positioned within the housing 4 with the spring 8 positioned in a recess 10 in the housing 4 so that it contacts the underside of the catch 9 and placing upward pressure on the underside of the catch 9 when assembled in housing 4.

FIGS. 3, 4, 5, and 6 show the extended receiver 1 in side, bottom cross-sectional, bottom and side cross-sectional views. At the distal end of the interchangeable barrel receiver 1 the receiver is provided with two tubular recesses 11 and 12 for bushing 2 to fit into, and on the underside of the distal end of the interchangeable barrel receiver 1, holes 7 are positioned for attachment of the quick detach mechanism housing 4. A longitudinal rectangular slot 13 is provided on the underside of the interchangeable barrel receiver 1 and this is positioned between holes 7. Slot 13 is provided to allow for catch 9 to protrude upwards through a corresponding slot (not shown) in bushing 2. This allows for catch 9 (under pressure from spring 8) to engage an angled surface on the underside of a barrel 3 or sound suppressed barrel assembly 3*a* when a barrel 3 or sound suppressed barrel assembly 3*a* is placed into the interchangeable barrel receiver 1.

Figure 9:
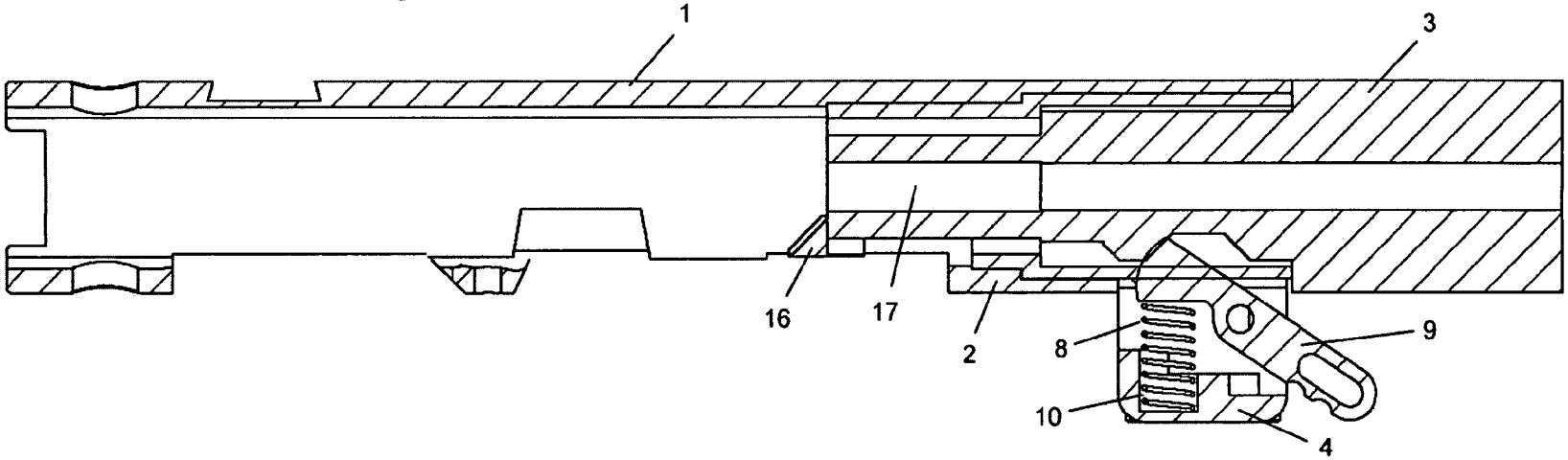
FIG. 9 is a cross-sectional view of an interchangeable barrel receiver with the quick detach mechanism.
Figure 10:
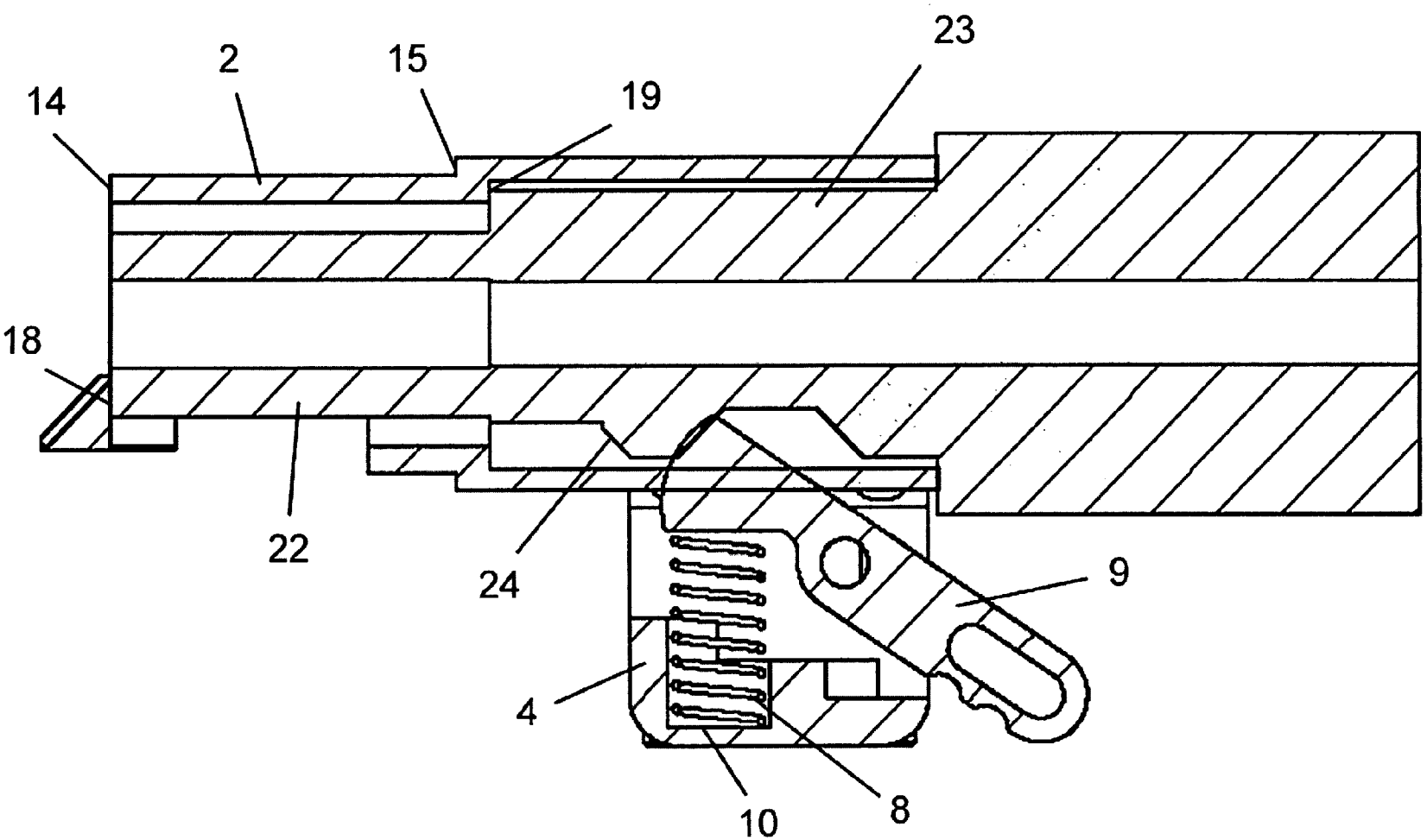
FIG. 10 is a cross-sectional view of the receiver bushing and a barrel fitted into the receiver bushing with the quick-detach mechanism.
Figure 11:
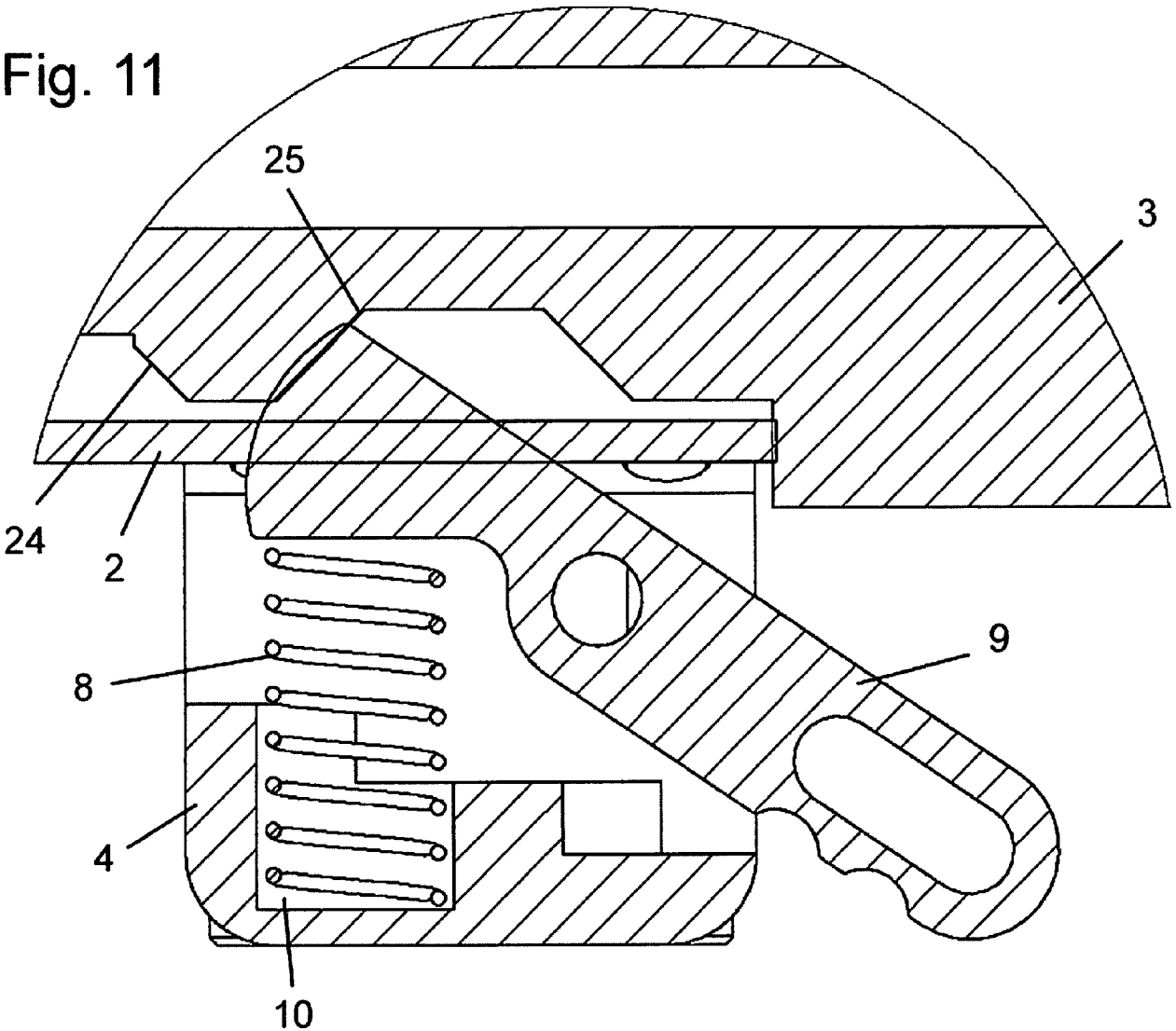
FIG. 11 is an enlarged view of a portion of FIG. 10 showing the quick detach mechanism when the barrel is positioned in the receiver bushing.

FIGS. 9, 10 and 11 show the relationship between the bushing, the barrel and the interchangeable barrel receiver. Bushing 2 has two external shoulders 14 and 15 of different diameters that match the two recesses 11 and 12 of the interchangeable barrel receiver 1, and when bushing 2 is inserted into interchangeable barrel receiver 1, these external shoulders butt up against the two recesses. Bushing 2 is press-fitted into interchangeable barrel receiver 1 and is also retained by the four screws 5 of the quick detach mechanism. This is to ensure that the forward motion of the bolt of the pistol does not push out the press-fitted bushing when firing occurs. To further retain the bushing in the interchangeable barrel receiver 1, a cross pin (not shown) or a key and key way as well as welding (not shown) may be used to further ensure retention of the bushing 2 in the interchangeable barrel receiver 1. Bushing 2 is provided with an integral feed ramp 16 to allow for feeding of cartridges into the chamber 17 of a barrel 3 or sound suppressed barrel assembly 3*a* when a barrel 3 or sound suppressed barrel assembly 3*a* is fitted to the interchangeable barrel receiver. On the distal underside of bushing 2 is a longitudinal cutout (not shown) that is in alignment with slot 13 on the interchangeable barrel receiver 1. This longitudinal cutout allows for the passage of the catch 9 through bushing 2 to retain barrel 3 or sound suppressed barrel assembly 3*a* when either barrel 3 or sound suppressed barrel assembly 3*a* are inserted into interchangeable barrel receiver 1. Bushing 2 has two internal shoulders 18 and 19 that align with two external diameters on barrel 3 or sound suppressed barrel assembly 3*a* when barrel 3 or sound suppressed barrel assembly 3*a* is inserted into bushing 2. Internal shoulder 18 is positioned at the proximal end of bushing 2, and when barrel 3 or sound suppressed barrel assembly 3*a* is inserted into bushing 2, internal shoulder 18 acts as a stop and also positions the chamber 17 of the barrel 3 or sound suppressed barrel assembly 3*a* in alignment with the feed ramp 16. Internal shoulder 19 also acts as a stop for barrel 3 or sound suppressed barrel assembly 3*a* upon insertion into bushing 2. In FIG. 1, bushing 2, barrel 3 and sound suppressed barrel assembly 3*a* are shown in an exploded perspective view and are shown with longitudinal slots or extractor slots 20 and 21 respectively. When barrel 3 or sound suppressed barrel assembly 3*a* is inserted into the interchangeable barrel receiver 1, the two extractor slots are in alignment. These extractor slots are positioned to allow for the extractor (not shown) of the bolt (not shown) of the Ruger™ Mk I/II/III™ or .22/45™ pistol to fit into the chamber 17 of the barrel 3 or sound suppressed barrel assembly 3*a* (when fitted to the interchangeable barrel receiver 1). This will allow for extraction of unfired cartridges or fired cartridge cases from the chamber 17 of the barrel 3 or sound suppressed barrel assembly 3*a*.

Barrel 3 and the barrel portion of sound suppressed barrel assembly 3*a* are provided with two reduced diameter sections 22 and 23. When the barrel or sound suppressed barrel assembly is inserted into the interchangeable barrel receiver 1, these reduced diameter sections butt up against internal shoulders 18 and 19 of bushing 2, preventing any further rearward movement of the barrel. These reduced diameter sections also act in conjunction with the internal shoulders of the bushing as alignment surfaces to ensure proper alignment between the barrel 3 or sound suppressed barrel assembly 3*a* and the bushing 2. As previously described, barrel 3 and sound suppressed barrel assembly 3*a* have an extractor slot 21 that aligns with extractor slot 20 of bushing 2 upon insertion into the interchangeable barrel receiver 1. Chamber 17 is provided at the proximal end of barrel 3 and the barrel portion of sound suppressed barrel assembly 3*a* for chambering of cartridges as is well known in the art. On the underside of barrel 3 and the barrel portion of sound suppressed barrel assembly 3*a*, two transverse angled surfaces 24 and 25 are provided. Transverse angled surface 24 is angled towards the distal or front end of the barrel while transverse angled surface 25 is angled towards the proximal or rear end of the barrel. These transverse angled surfaces are positioned in the reduced diameter section 23 and when the barrel is inserted into interchangeable barrel receiver 1, angled surface 25 is in alignment with slot 13 of the receiver and the corresponding slot in bushing 2. A cut is provided in angled surface 25 and the upper surface of catch 9 fits into this cut and is held under spring pressure up and against this angled surface to retain the barrel 3 or sound suppressed barrel assembly 3*a* in the interchangeable barrel receiver 1. While this particular method of barrel retention is disclosed and thus described in detail and shown in illustrations, it should be understood that this is for illustrative purposes only and other known methods of barrel retention may be used.

When bushing 2 is press-fitted into interchangeable barrel receiver 1, the quick detach mechanism is assembled into housing 4 and attached to interchangeable barrel receiver 1 by the four screws 5. These screws also retain bushing 2 in interchangeable barrel receiver 1. The barrel 3 or sound suppressed barrel assembly 3*a* may be attached to the interchangeable barrel receiver or pistol by two methods. The first is simply by inserting the barrel 3 or sound suppressed barrel assembly 3*a* into the interchangeable barrel receiver or pistol, ensuring that the barrel 3 or sound suppressed barrel assembly 3*a* is positioned correctly to allow insertion. Rearward movement of the barrel 3 or sound suppressed barrel assembly 3*a* results in the transverse angled surface 24 engaging the upper surface of catch 9 and pushing it in a downward movement against the spring 8. Further rearward movement of the barrel 3 or sound suppressed barrel assembly 3*a* results in transverse angled surface 25 being positioned to allow catch 9 to be pushed upward by spring 8 and the upper surface of catch 9 snapping into position against the transverse surface 25. At the same time, the barrel 3 or sound suppressed barrel assembly 3*a* is unable to be moved in a rearward direction as reduced diameter sections 22 and 23 come into contact with the internal shoulders 18 and 19 of bushing 2. The barrel 3 or sound suppressed barrel assembly 3*a* is unable to be pulled forward as it is being held in place by a combination of the spring 8 and the catch 9 acting against the angled transverse surface. The second method of attachment is by pushing upwards on catch 9 while inserting barrel 3 or sound suppressed barrel assembly 3*a* into the interchangeable barrel receiver 1 or pistol. This depresses the rear end of the catch 9 and when no further rearward movement of the barrel 3 or sound suppressed barrel assembly 3*a* is possible, catch 9 is then released. Catch 9 is then pushed upwards under pressure from spring 8 and against the transverse angled surface 25, retaining the barrel 3 or sound suppressed barrel assembly 3*a* in the interchangeable barrel receiver. To remove the barrel 3 or sound suppressed barrel assembly 3*a* from the interchangeable barrel receiver or pistol, one simply pushes upward on the catch 9 while at the same time pulling the barrel 3 or sound suppressed barrel assembly 3*a* forward and out of the interchangeable barrel receiver or pistol While the invention has been shown and described with reference to a certain specific preferred embodiment, modification may now suggest itself to those skilled in the art. Such modifications and various changes in form and detail may be made herein without departing from the spirit and scope of the invention. Accordingly, it is understood that the invention will be limited only by the appended claims.

The invention claimed is:

1. A firearm having a user-interchangeable barrel, comprising:

a tubular receiver having a bolt which reciprocates within the receiver;

a tubular barrel bushing press-fitted into the receiver, the bushing having an integral feed ramp independent of a barrel and at least two tubular recesses of differing dimension separated by an edge which presents an internal shoulder surface;

at least one interchangeably detachable barrel having an unthreaded proximal end for insertion into the barrel bushing, a chamber at the proximal end, and an external shoulder surface axially spaced from the proximal end configured to abut the internal shoulder surface of the barrel bushing when axially inserted into the tubular recesses of the barrel bushing for assembly without rotation, the chamber having an edge surface configured to directly abut and operably align with the feed ramp when installed;

a latch assembly having a spring biased catch member positioned to engage and secure the barrel operably in place in the receiver and barrel bushing without rotation of the barrel and manually displaceable by the user to release the barrel for easy disassembly, thereby allowing easy interchangeability of barrels.

2. The firearm of claim 1, including at least one interchangeably detachable sound suppressed barrel.

3. The firearm of claim 1, wherein the receiver includes two tubular recesses of differing dimension separated by an edge which presents an internal shoulder surface and wherein the barrel bushing is configured to press-fit the tubular recesses of the receiver and includes an external shoulder surface configured to abut the internal shoulder surface of the receiver.

4. The firearm of claim 1, the chamber edge surface further comprising an extractor-receiving slot.

5. The firearm of claim 1, said barrel further comprising first and second longitudinally spaced apart angled surfaces, the first surface configured to displace the catch member as the barrel is axially inserted into the barrel bushing and the second surface configured to provide an abutment surface against which the latch member bears when the barrel is in an assembled position.

* * * * *